US005277318A

United States Patent [19]

Smalley, Jr. et al.

[11] Patent Number: 5,277,318

[45] Date of Patent: Jan. 11, 1994

[54] APPARATUS FOR REMOVING CONTAMINATION FROM LOW DENSITY PARTICULATE MATERIALS

[75] Inventors: Robert B. Smalley, Jr.; Bert H. Parry, both of Brigham City, Utah

[73] Assignee: Thiokol Corporation, Ogden, Utah

[21] Appl. No.: 841,940

[22] Filed: Feb. 26, 1992

[51] Int. Cl.[5] ..... B07B 1/00

[52] U.S. Cl. ..... 209/255; 222/189; 222/564; 209/417; 209/305; 209/302; 209/365.1

[58] Field of Search ..... 209/417, 420, 682, 240, 209/244, 245, 257, 260, 284, 285, 286, 305, 306, 370, 371, 302, 255, 365.1; 222/189, 547, 564

[56] References Cited

U.S. PATENT DOCUMENTS

| | | | |
|---|---|---|---|
| 1,138,291 | 5/1915 | Hilliard | 222/189 |
| 1,283,384 | 10/1918 | Weil . | |
| 1,350,080 | 8/1920 | Notter | 209/417 |
| 2,142,790 | 1/1939 | Kodaira | 221/11 |
| 2,274,914 | 3/1942 | Wilcox | 209/244 |
| 2,422,263 | 6/1947 | Schara | 222/126 |
| 2,434,642 | 1/1948 | Deardorff | 229/15 |
| 3,185,357 | 5/1965 | Merkel | 222/425 |
| 3,272,395 | 9/1966 | Lawyer | 222/189 |
| 3,342,383 | 9/1967 | Klygis et al. | 222/454 |
| 4,433,800 | 2/1984 | Owens | 222/547 |
| 4,658,992 | 4/1987 | Peleus | 222/199 |

FOREIGN PATENT DOCUMENTS 1279356 10/1968 Fed. Rep. of Germany .

*Primary Examiner*—H. Grant Skaggs
*Attorney, Agent, or Firm*—Madson & Metcalf

[57] ABSTRACT

An apparatus is provided for the removal of oversized contaminants from particulate material the is particularly suitable for the removal of contaminants from low density, high surface area particulate materials. The removal of contaminants is accomplished during the transfer of the particulate material from its storage or transport container to a receiving container. The apparatus comprises an assembly having a weir, a trap disposed adjacent said weir, a screen o for separating particulate material from oversized contaminants, a baffle, and an opening through which particulate material will flow freely. The weir has a weir trap flange extending laterally from a weir wall. The trap is configured to capture contaminants if the container to which the assembly is secured is maneuvered to initiate the flow of the particulate material from the container to the receiving container. When so maneuvered, the lowermost portion of the trap in the proximity of the flow of the particulate materials subtends the weir. The screen permits particulate material trapped within the trap to pass therethrough so that the container can be completely emptied of particulate material while separating and capturing oversized contaminants. The baffle is spaced from the weir and disposed to deflect the flow of the particulate material towards the trap. The flow of particulate material follows a tortured path around the baffle and over the weir to exit the container through the opening.

44 Claims, 4 Drawing Sheets

APPARATUS FOR REMOVING CONTAMINATION FROM LOW DENSITY PARTICULATE MATERIALS

FIELD OF THE INVENTION

The present invention relates to an apparatus used for the removal of oversized contamination from materials that are too light (low density) to pass through a screen readily without an external driving force, and more particularly to an apparatus used to remove contamination from low density propellant materials.

BACKGROUND OF THE INVENTION

In the preparation of propellants it is critically important to properly handle the ingredients of the propellants to assure safety. For many solid rocket propellants, mixers ranging in size from small (one pint) to extremely large (600 to 1000 gallons) are used to combine the ingredients. Such mixers use blades that have narrow tolerance between the blades and the interior wall of the mixer (usually fractions of an inch). During mixing, the ingredients are viscous and later solidify during curing of the mixture. As can be easily appreciated, a major safety concern is to eliminate or reduce undesired friction in the mixture during mixing. Hence, it is imperative that the contents of the mixture contain particles that are finer than the blade clearance. Devastating explosions have occurred as the result of friction caused by mixture contamination by some object or particle that is larger than the blade clearance.

In the manufacture of certain propellants it is particularly important to use ingredients that have a very high surface area to volume ratio. Certain desirable characteristics of a propellant such as burn rates and viscosity are affected by the ratio of surface area to volume of the propellant constituents. Consequently, low density or sub-micron particles of various materials are used frequently in the manufacture of solid propellants.

However, the use of low density or sub-micron particles as ingredients in a propellent mixture can cause significant safety problems. Small, high surface area particles are subject to viscose (stokes) drag in air and are not heavy enough to pass through a screen readily when driven by gravity or vibration. Such materials are too light to fall through a safety screen without an external driving force. For example, low density fumed silica particles (a silicon dioxide product known as "Cab-O-Sil") have a size of approximately 0.03 microns. The sub-micron iron oxide material known as "Pyrocat" has also been used in propellant formulations. This material has a surface area to weight that is of the magnitude of 100 square meters per gram or more. For such materials, the force of gravity is insufficient to draw the material through a #8 mesh safety screen (a screen with mesh openings of about 0.15 inches). Consequently, it is extremely difficult to screen the material for contamination.

Heretofore, there have been two methods for contamination removal from low density materials such as Cab-O-Sil and Pyrocat. One method is to use expensive solid particle fluidizing systems to move the materials through a screen using an air column. This method requires expensive capital investment for the fluidizing equipment, and the equipment is large and bulky and certainly not portable. Additionally, such equipment is usually designed to handle a specific material and not other low density materials.

The other method is simply to sift the material by hand through a mesh screen. As can be appreciated, this method has several drawbacks. The sifting must be done in an enclosed area and the person doing the sifting must wear appropriate breathing apparatus and goggles. Since the materials are so light, if they become airborne it may take minutes or hours for the materials to settle to the ground. Further, some low density materials can be catalytic, thereby introducing a serious hazard for explosion if an inadvertent spark occurs in a room of airborne particles. Also, so little material passes through the screen that the process is extremely time consuming. For example, it has required as much as one half hour to screen 0.4 pounds of Pyrocat for a propellant mix. This means that it may take as much as 133 man hours to screen enough material for a 600 gallon propellant mix.

Hence, it would be a significant advance in the art to provide an apparatus that could quickly separate light, low density, high surface area materials from coarser materials or hazardous contamination where fluidizing systems are not practical or have not been developed or where hand sifting is not practical.

OBJECTS AND BRIEF SUMMARY OF THE INVENTION

In view of the foregoing needs and problems experienced in screening light, low density particulate materials, it is a primary object of the present invention to provide an apparatus and a method for separating coarser materials or contamination from sub-micron size particles quickly without the use of expensive and bulky equipment.

It is another object of the present invention to provide an apparatus that is portable and easily manipulated to screen low density materials safely.

A further object of the present invention is to provide an apparatus and method for reducing man hour commitment in safety screening low density materials and thereby reducing costs and the time in which the low density materials are exposed to possible external contamination.

Another object of the present invention is to provide an apparatus that enables a person to handle the safety screening of low density materials with minimal contamination of the work environment.

A further object of the present invention is to provide an apparatus that separates oversized contaminants from low density particulate material and permits the particulate material to be completely emptied from a container while capturing the contaminants within the container.

Still another object of the present invention is to provide an apparatus that is easily adaptable to industries other than propellant manufacture such as the paint industry or the food industry.

The foregoing objects are accomplished by an apparatus of the present invention comprising a baffle, a trap, and a weir to direct the flow of low density material over a tortured path so that contaminants are captured within the trap.

One preferred embodiment of the present invention may be used to remove contamination from low density particulate material that is transported in a container such as a one gallon can similar to a paint can. Low density particulate materials such as fumed silica and sub-micron iron oxide and the like act similar to a liquid when confined in a restricted volume. Hence, within the container, the low density particulate materials flow in a manner similar to a liquid. Additionally, if any particles of the material do become airborne, they remain confined within the container and do not escape to the atmosphere.

The apparatus of this preferred embodiment is an assembly, hereinafter referred to as the lid assembly, with a generally central weir that may be secured to the top of the container in the same manner as the lid for a paint can. The assembly comprises a baffle, a trap, and a weir. The baffle serves as a barrier that shields the weir and directs the flow of the low density particulate material into the trap. The trap comprises a ring-like volume defined by an annular screen flanked by a cylindrical outer wall and a cylindrical inner wall which forms part of the weir. The weir comprises the cylindrical inner wall and a weir trap flange.

When the lid assembly is secured to the container and maneuvered and mildly agitated so that a flow of the low density particulate material is initiated, the trap begins to fill with the low density particulate material in the proximity of the flow. Higher density and oversized contaminants travel in the flow and settle to the lowermost portion of the trap where such contaminants are captured in the trap. When the trap fills to capacity in the area of the flow of the low density materials, the flow will take a tortured path about the weir and exit the container. Heavier and oversized contaminants are incapable of traveling the same tortured path and remain captured in the trap. The low density particulate material is taken from the container much more rapidly than under the presently used screening procedure because most of the material averts passage through a screen. Additionally, the small amount of low density particulate materials captured within the trap may pass through the screen while leaving the contaminants captured within the trap. This enables the user to completely empty the container of low density particulate material while separating out the oversized contaminants.

Another embodiment of the present invention may be used to remove contamination from low density particulate material transported in larger containers such as large plastic bags or 55 gallon drums. Low density particulate materials are frequently made available from the manufacturer in large plastic bags or in drums.

The apparatus of this additional preferred embodiment is an assembly, hereinafter referred to as the hopper assembly, which acts like a hopper that assists in the transfer of low density particulate material from a plastic bag or drum into a receiving container. This assembly also comprises a baffle, a trap, and a weir, but the disposition of the baffle, trap, and weir differ from the previously described preferred embodiment. The baffle is annularly disposed and serves as a barrier that shields the weir and directs the flow of the low density particulate material into the centrally disposed generally circular trap. The trap comprises an area defined by a circular screen circumferentially enclosed by a cylindrical outer wall which forms part of the weir. The weir comprises the cylindrical outer wall and an inwardly disposed weir trap flange.

When the hopper assembly is secured to the container, maneuvered and agitated so that a flow of the low density particulate material is initiated, the trap begins to fill with the low density particulate material. Higher density and oversized contaminants travel in the flow and settle onto the screen which borders the lowermost portion of the trap. Such contaminants are captured in the trap. When the trap fills to capacity, the flow of the low density materials follows a tortured path about the weir and exits the hopper assembly. Heavier and oversized contaminants are incapable of traveling the same tortured path and remain captured in the trap. In this manner, the low density material is transferred from the drum or plastic bag into a receiving container much more rapidly than under the screening procedure now used because most of the material averts passage through a screen. Additionally, the low density particulate materials captured within the trap may pass through the screen while leaving the contaminants captured within the trap. This enables the user to completely empty the container and the hopper assembly of low density particulate material while separating out the oversized contaminants.

These and other objects and features of the present invention will become more fully apparent through the following description and appended claims taken in conjunction with the accompanying drawings.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
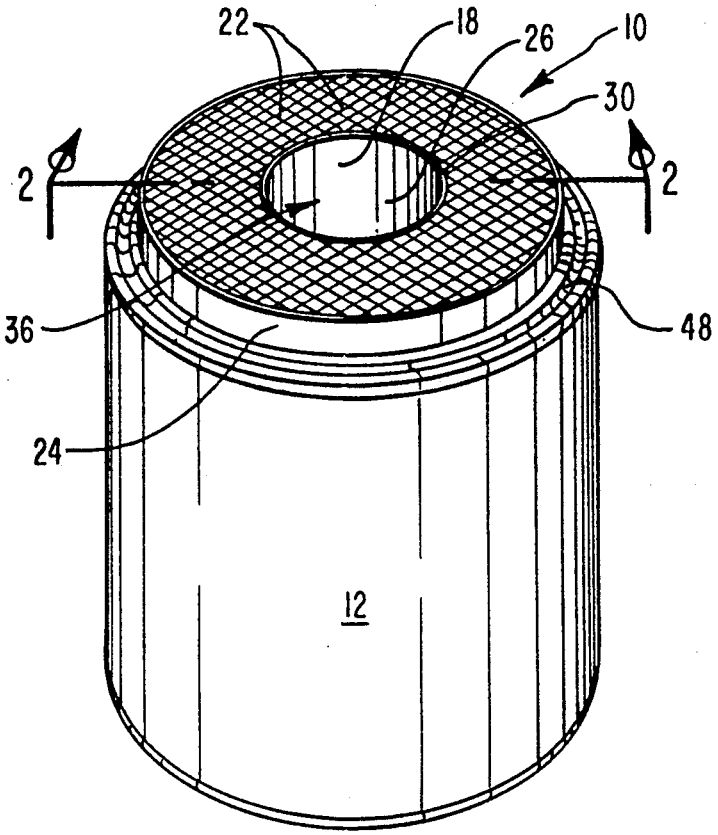
FIG. 1 is a perspective view of the apparatus of the present invention disposed in sealed engagement to the top of a container.
Figure 2:
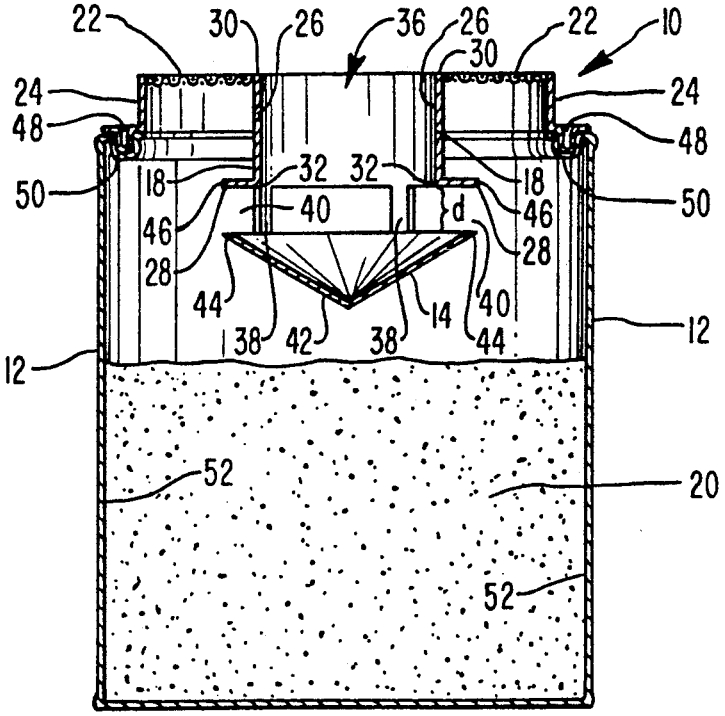
FIG. 2 is a sectional view along Line 2—2 of FIG. 1 showing the container disposed in an upright position with the lid assembly secured thereto and low density particulate material disposed within the container.
Figure 3:
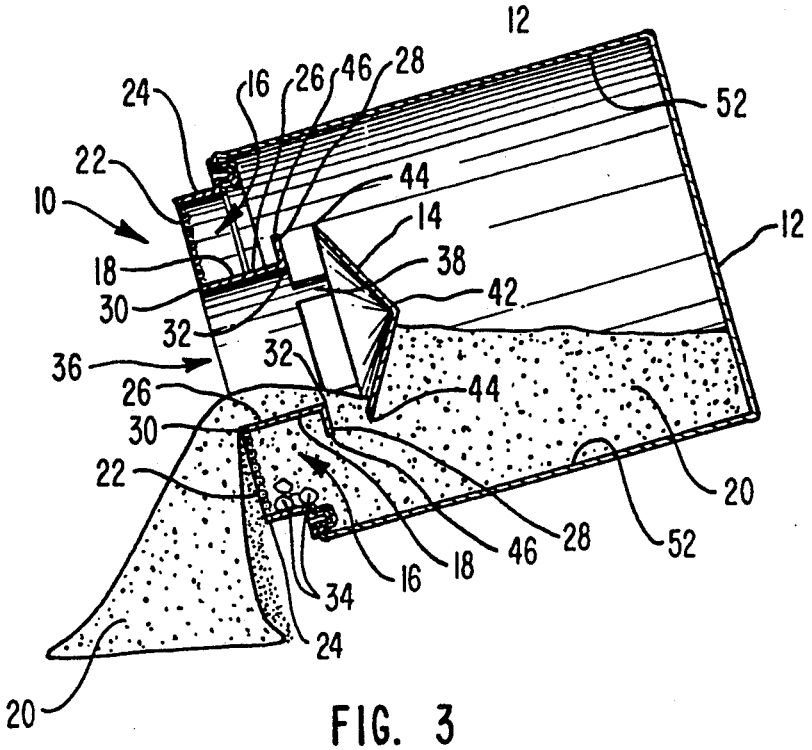
FIG. 3 is a sectional view of the container disposed in a pouring position with the lid assembly secured thereto and the low density particulate material being poured from the container.

Referring now specifically to the drawings, wherein like numerals indicate like parts throughout, FIGS. 1 through 3 illustrate a preferred embodiment of the present invention which may be used to remove oversized contamination from low density particulate material that is transported in a container such as a one gallon can similar to a paint can.

The apparatus of this preferred embodiment is an assembly, hereinafter generally referred to as the lid assembly 10, which may be secured to the top of a container 12 in the same manner as the lid for a paint can (see FIGS. 1 and 2). Also, the lid assembly 10 is preferably configured to be generally symmetrical about a central axis for the lid assembly 10. In this manner, the lid assembly 10 will operate equally well when tilted in any direction from the vertical. Although a generally symmetrical configuration is preferred, it should be understood that lid assemblies 10 of other configurations such as rectangular or elliptical are contemplated herein as being within the intended scope of the present invention.

The lid assembly 10 comprises a baffle 14, a trap (generally designated 16), and a weir 18 The baffle 14 serves as a barrier that shields the weir 18 and directs the flow of low density particulate material 20 into the trap 16. The trap 16 comprises a ring-like volume defined by an annular permeable member such as a screen 22 flanked by a cylindrical outer wall 24 and a cylindrical inner wall or weir wall 26 which are Concentrically spaced from each other.

As shown best in FIG. 2, the weir 18 comprises the cylindrical inner wall or weir wall 26 and a weir trap flange 28. The weir wall 26 has a base end 30 and a top end 32. The weir trap flange 28 extends laterally from the weir wall 26 at the top end 32 in a direction substantially normal to the weir wall 26 and away from a central axis of said assembly 10. Although the weir trap flange 28 is shown in FIGS. 2 and 3 as extending from the weir wall 26 substantially normal to the weir wall 26, the angle at which the weir trap flange 28 extends may differ from the perpendicular without departing from the spirit of the invention so long as the weir trap flange 28, however angularly disposed, serves to trap contaminants 34 within the trap 16. The weir wall 26 preferably has a height from the base end 30 to the top end 32 which is greater than the height of the cylindrical outer wall 24 so that the trap 16 is clearly defined as lying within the confines defined by the weir wall 26, the screen 22, and the cylindrical outer wall 24. Further, the height of the weir wall 26 should be sufficient to define a trap 16, because if the weir wall 26 has insufficient height, no particular trap 16 is defined and the assembly 10 is not as efficient in removing contaminants 34 from the low density particulate material 20. It has been found that configuring the weir wall 26 to have a height greater than the cylindrical outer wall 24 is particularly advantageous in causing the flow of low density particulate material 20 to follow a tortured path before exiting the container 12 and is capturing contaminants 34 which have settled into the trap 16.

The screen 22 which borders the trap 16 encircles the weir 18 and is connected to the weir 18 at the base end 30. The screen 22 that is typically used now to separate oversized contaminants 34 from low density particulate material 20 used as ingredients for a propellant is a #8 mesh screen. Such screens are known as safety screens because they are used to separate out contaminants 34 that are larger than the clearance in the propellant mixer. Low density particulate materials 20 which are used as ingredients for propellants such as fumed silica and sub-micron iron oxide and the like are so lightweight that they act similar to a liquid when confined in a restricted volume. Hence, within the container 12, the low density particulate materials 20 flow in a manner similar to a liquid and oversized contaminants 34 within the low density particulate materials 20 will flow or settle in a similar manner. Oversized contamination 34 that escapes the safety screen can get caught between the wall of the mixer and a mixer blade, causing friction that could detonate the propellant. Hence, it is preferred that the screen 22 used in the lid assembly 10 be a #8 mesh screen. However, it should be understood that a permeable member other than a #8 mesh screen can be used without departing from the spirit of the invention. For example, a different sized screen or a perforated plate could be used to separate contaminants such as gravel or pebbles from flour or other particulate food products or other contaminants from paint.

Although other screens 22 can be used, the mesh size for the screen 22 should be sufficient to permit the passage therethrough of the low density particulate material 20 while not permitting the passage therethrough of oversized contamination 34. In this manner, as illustrated in FIG. 3, the low density particulate material 20 that gets captured in the trap 16 and does not exit the container 12 by passing over the weir 18, can be emptied from the container 12 through the screen 22, leaving the oversized contaminants 34 behind captured within the trap 16.

When the lid assembly 10 is secured to the container 12 and maneuvered and mildly agitated so that a flow of the low density particulate material 20 is initiated, the trap 16 begins to fill with the low density particulate material 20 in the proximity of the flow as best shown in FIG. 3. Higher density and oversized contaminants 34 travel in the flow and settle to the lowermost portion of the trap 16 where such contaminants 34 are captured in the trap 16. Any particles of the low density particulate material 20 that do become airborne remain confined within the container 12 and do not escape to the atmosphere. When the trap 16 fills to capacity in the area of the flow of the low density particulate materials 20 (see FIG. 3), a portion of the flow will take a tortured path about the weir 18 and exit the container 12 through an opening 36 in the lid assembly 10 without passing through the screen 22. Heavier and oversized contaminants 34 are incapable of traveling the same tortured path and remain captured in the trap 16.

The low density particulate material 20 is taken from the container 12 much more rapidly than by the presently known screening process because most of the particulate material 20 averts passage through the screen 22. With mild agitation, the low density particulate materials 20 captured within the trap 16 may pass through the screen 22 while leaving the contaminants 34 captured within the trap 16. Hence, only a small portion of the low density particulate 20 contents of the container 12 pass through the screen 22, and the screen 22 enables the user to completely empty the container 12 of low density particulate material 20 while separating out the oversized contaminants 34.

As shown best in FIG. 3, the baffle 14 serves as a barrier that shields the weir 18 and directs the flow of low density particulate material 20 away from a direct exit through the opening 36 into the trap 16. The baffle 14 is supported in a disposition which is spaced from the weir 18 by support fingers 38 such that flow of low density particulate material 20 is not impeded. Opening 36 has an annular entry portal 40 that lies between the weir trap flange 28 and the baffle 14. The width of the entry portal 40, designated by bracket d in FIG. 2, may be considerably larger that the mesh size of the screen 22 so that the low density particulate material 20 will flow freely through the exit portal 40 and opening 36 in exiting the container 12. Additionally, since the exit portal 40 is annular, air is permitted to enter the container 12 through whatever portion of the exit portal 40 is not receiving the flow of the low density particulate material 20. This prevents the creation of a vacuum within the container 12 and allows the low density particulate material to flow freely from the opening 36.

Preferably, with the embodiment illustrated in FIG. 1 through 3, the baffle 14 has a configuration that has a conical surface 42. By having a conical surface 42, the baffle 14 will act to direct flow of the low density particulate material 20 away from the opening 36 and towards the trap 16 no matter which direction from the vertical the container 12 is tilted to initiate the flow of the particulate material within the container 12. A flat surfaced baffle 14 could be used, but it would not be as effective as the baffle 14 with a conical surface 42 as shown in FIGS. 2 and 3.

It is also preferred that the outermost or peripheral edge 44 of the baffle 14 which is disposed proximate to the said weir trap flange 28 is spaced from the central axis of the assembly 10 a distance which is equal to or greater than the distance at which the outermost edge 46 of the weir trap flange 28 is spaced from the central axis. In this manner, particulate material 20 that is directed by the baffle 14 is less likely to avert the trap 16 and take a less tortured path through the exit portal 40.

In order to empty the desired contents from a container 12 containing low density particulate material 20 while separating out oversized contaminants 34, the lid assembly 10 is releasably secured to the container 12. If the container 12 is of the paint can variety, the lid assembly 10 further comprises an annular ridge connector 48 which is capable of sealing engagement with a container 12 having an annular depression 50 about the mouth of the container 12 (see FIGS. 2 and 3). Once the lid assembly 10 is secured as shown in FIGS. 1 through 3, the container 12 with the lid assembly 10 secured thereto may be maneuvered in a tilting motion to cause the low density particulate material 20 contents to flow. Mild agitation of the container 12 may assist the flow. As shown in FIG. 3, the flow of the particulate material 20, under the force of gravity, will be directed towards the lid assembly 10. The portion of the flow that does not encounter the baffle 14, moves down the inside wall 52 of the container 12 towards the trap 16. The portion of the flow that does encounter the baffle 14, is directed away from the opening 36 and towards the trap 16. The movement of the contaminants 34 within the flow will generally be in the same direction as the flow of the low density particulate material 20. The contaminants 34 ultimately settle within the trap 16 (see FIG. 3).

As the trap 16 begins to fill with the low density particulate material 20 in the proximity of the flow. Higher density and oversized contaminants travel in the flow and settle to the lowermost portion of the trap 16 where such contaminants 34 are captured in the trap 16. When the trap 16 fills to capacity in the area of the flow of the low density particulate materials 20, the upper portion of the flow will take a tortured path about the weir 18, through the exit portal 40 and exit the container 12 through the opening 36. Heavier and oversized contaminants 34 are incapable of traveling the same tortured path and remain captured in the trap 16.

Because most of the low density particulate material 20 averts the screen 22, the low density particulate material 20 is taken from the container 12 much more rapidly than under the known screening procedure. The low density particulate materials 20 captured within the trap 16 are recovered because such materials 20 when mildly agitated may pass through the screen 22 while leaving the contaminants 34 captured within the trap 16. Thus, the container 12 may be completely emptied of the desired low density particulate material 20 while separating out the oversized contaminants 34.

Another embodiment of the present invention is illustrated in FIGS. 4 through 7. This preferred embodiment of the present invention may be used to remove contamination from low density particulate material 20 transported in larger containers such as large plastic bags or 55 gallon drums. Low density particulate materials 20 are frequently made available from the manufacturer in large plastic bags or in drums.

The apparatus of this additional preferred embodiment is an assembly, generally designated hopper assembly 110, which acts like a hopper that transfers low density particulate material 20 from a plastic bag 112 or drum (not shown) into a receiving container 113. This hopper assembly 110 also comprises a baffle 114, a trap 116, and a weir 118, but the disposition of the baffle 114, trap 116, and weir 118 differ from the previously described preferred lid assembly 10 embodiment. The baffle 114 is annularly disposed and serves as a barrier that shields the weir 118 and directs the flow of the low density particulate material 20 into the centrally disposed generally circular trap 116. The trap 116 comprises a volume defined by a circular screen 122 circumferentially enclosed by a cylindrical outer wall 126 which forms part of the weir 118. The screen 122 and cylindrical outer wall 126 are supported by a plurality of support arms 139 connecting the cylindrical outer wall 126 to an exterior wall 124 in a spaced substantially concentric relationship.

Figure 5:
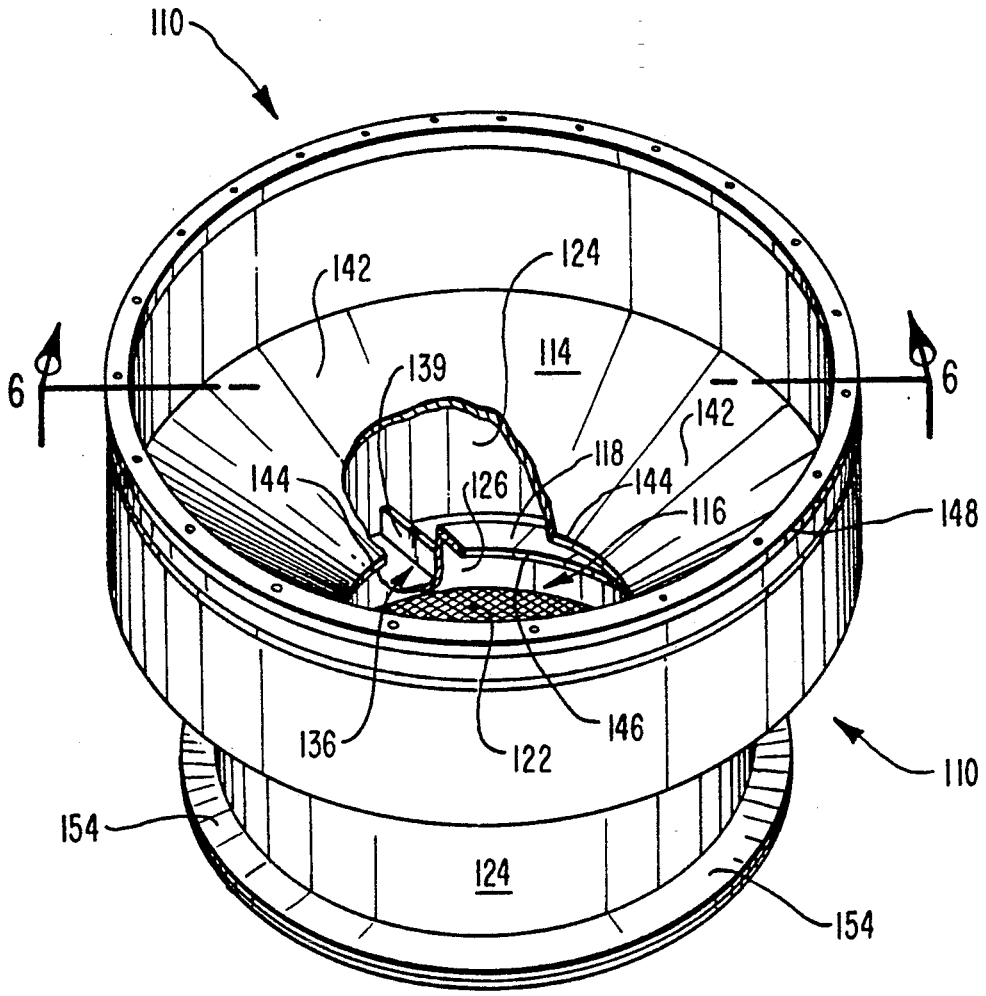
FIG. 5 is a perspective view of the hopper assembly with portions of the baffle and weir cut away to show the disposition of the various components.
Figure 6:
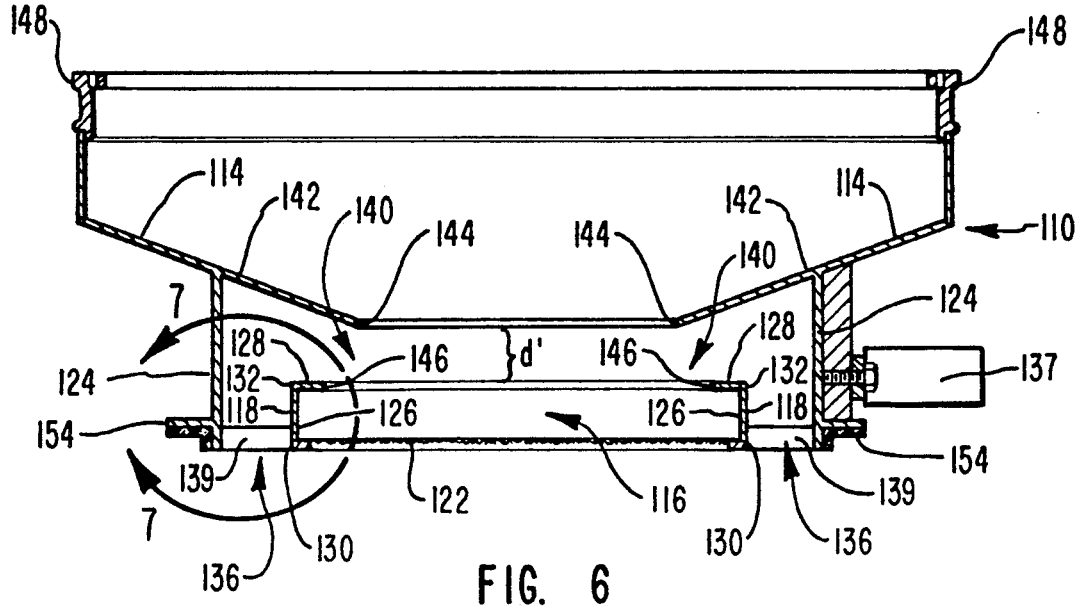
FIG. 6 is a sectional view of the hopper assembly along Line 6—6 of FIG. 5.
Figure 7:
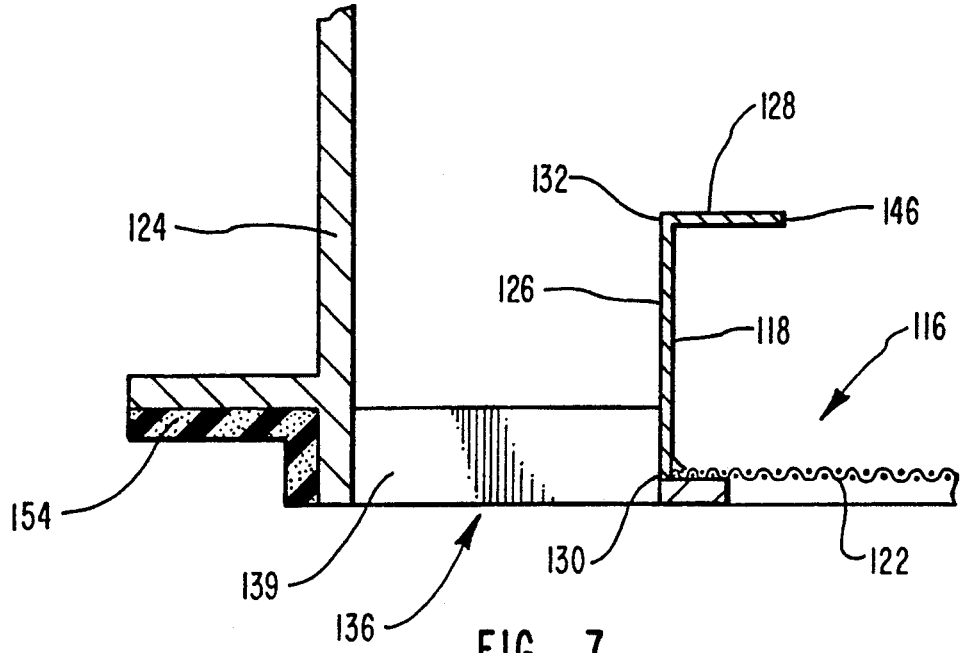
FIG. 7 is an enlarged view of a portion of the hopper assembly viewed along Line 7—7 of FIG. 6.

As shown best in FIGS. 6 and 7, the weir 118 comprises the cylindrical outer wall or weir wall 126 and an inwardly disposed weir trap flange 128. The weir wall 126 has a base end 130 and a top end 132. The weir trap flange 128 extends laterally from the weir wall 126 at the top end 132 in a direction substantially normal to the weir wall 126 and towards the central axis of the hopper assembly 110. Although the weir trap flange 128 is shown in FIGS. 5 through 7 as extending from the weir wall 126 substantially normal to the weir wall 126, the angle at which the weir trap flange 128 extends may differ from the perpendicular without departing from the spirit of the invention so long as the weir trap flange 128, however angularly disposed, serves to trap contaminants 34 within the trap 116. The weir wall 126 preferably has a height from the base end 130 to the top end 132 which is sufficient to define the trap 116, because if the weir wall 126 has insufficient height, no particular trap 116 is defined and the hopper assembly 110 is not as efficient in removing contaminants 34 from the low density particulate material 20. It has been found that configuring the weir wall 126 to have a height sufficient to cause the flow of low density particulate material 20 to follow a tortured path before exiting the hopper assembly 110 is particularly advantageous in capturing contaminants 34 which have settled into the trap 116.

The weir 118 which borders the trap 116 encircles the screen 122 and is connected to the screen 122 at the base end 130 of the weir 118. The screen 122, as described above with reference to the lid assembly 10 embodiment, is a #8 mesh screen. However, it should be understood that a permeable member other than a #8 mesh screen can be used without departing from the spirit of the invention. For example, a different sized screen or a perforated plate could be used to separate contaminants such as gravel or pebbles from flour or other particulate food products or other contaminants from paint.

Although other screens 122 can be used, the mesh size for the screen 122 should be sufficient to permit the passage therethrough of the low density particulate material 20 while not permitting the passage therethrough of oversized contamination 34. In this manner, the low density particulate material 20 that gets captured in the trap 116 and does not exit the hopper assembly 110 by passing over the weir 118, can be emptied from the container 112 and the hopper assembly 110 through the screen 122, leaving the oversized contaminants 34 behind captured within the trap 116.

When the hopper assembly 110 is secured to the container 112 and maneuvered so that a flow of the low density particulate material 20 is initiated, the trap 116 begins to fill with the low density particulate material 20. With the hopper assembly 110 embodiment, it is preferred to initiate the flow of the low density particulate material 20 within the container 112 by inverting the container 112. In this manner, higher density and oversized contaminants 34 travel in the flow and settle on the screen 122 which is the lowermost portion of the trap 116 where such contaminants 34 are captured in the trap 116. Any particles of the low density particulate material 20 that do become airborne remain confined within the container 112 or the hopper assembly 110 and do not escape to the atmosphere. When the trap 116 fills to capacity with low density particulate materials 20, the flow will take a tortured path about the weir 118 and exit the hopper assembly 110 through an annular opening 136. Heavier and oversized contaminants 34 are incapable of traveling the same tortured path and remain captured in the trap 116. The low density particulate material 20 is taken from the container 112 much more rapidly than by the presently known screening process because most of the particulate material 20 averts passage through the screen 122. The low density particulate materials 20 captured within the trap 116 may pass through the screen 122 while leaving the contaminants 34 captured within the trap 116. Hence, only a small portion of the low density particulate 20 contents of the container 112 pass through the screen 122, and the screen 122 enables the user to completely empty the container 112 and the hopper assembly 110 of low density particulate material 20 while separating out the oversized contaminants 34.

In order to facilitate the movement of the flow of the low density particulate material 20 from the container 112 through the hopper assembly 110 and into the receiving container 113, an agitator 137 may be provided which agitates the flow and/or vibrates the hopper assembly 110. This agitator 137 can be of a conventional type that is secured to the exterior of the hopper assembly 110.

As shown best in FIG. 6, the baffle 114 serves as a barrier that shields the weir 118 and directs the flow of low density particulate material 20 away from a direct exit through the opening 136 and towards the trap 116. The baffle 114 is disposed spaced from the weir 118 by an exterior wall 124 such that flow of low density particulate material 20 is not impeded. Opening 136 has an annular entry portal 140 that lies between the weir trap flange 128 and the baffle 114. The width of the entry portal 140, designated by bracket d' of FIG. 6, may be considerably larger that the mesh size of the screen 122 so that the low density particulate material 20 will flow freely through the exit portal 140 and opening 136 in exiting the container 112 and the hopper assembly 110.

Preferably, with the embodiment illustrated in FIGS. 5 and 6, the baffle 114 has a configuration that has a angled annular surface 142. By having an angled annular surface 142, the baffle 114 acts to direct flow of the low density particulate material 20 away from the opening 136 and towards the trap 116 when the container 112 is inverted to initiate the flow of the particulate material 20 from the container 112 and through the hopper assembly 110.

It is also preferred that the innermost or peripheral edge 144 of the baffle 114 which is disposed proximate to the said weir trap flange 128 is spaced from the central axis of the hopper assembly 110 a distance which is less than or equal to the distance at which the innermost edge 146 of the weir trap flange 128 is spaced from the central axis. In this manner, particulate material 20 that is directed by the baffle 114 is less likely to avert the trap 116 and take a less tortured path through the exit portal 140.

Figure 4:
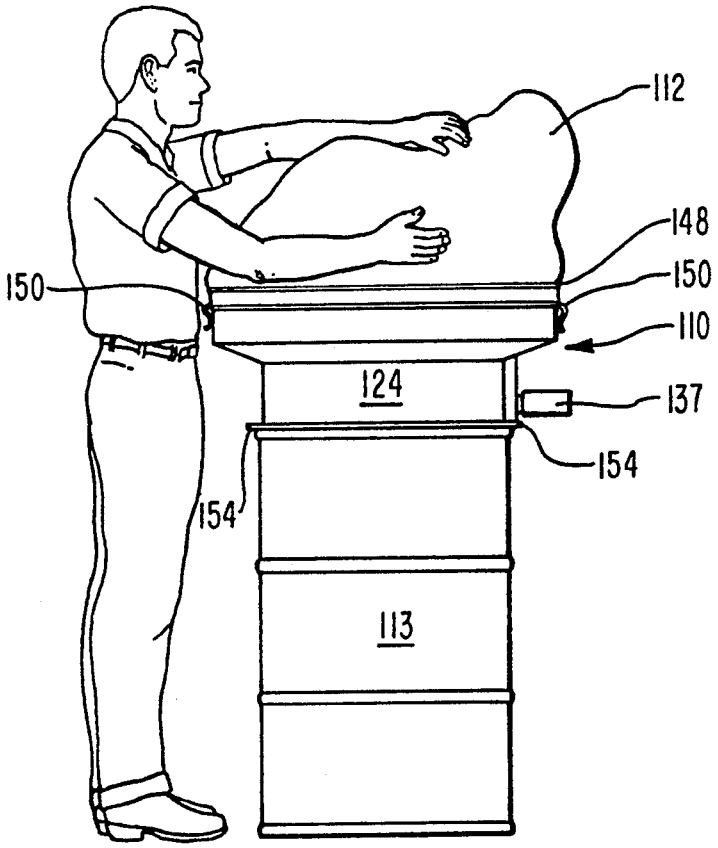
FIG. 4 is an elevational view of another preferred embodiment of the apparatus of the present invention showing a plastic bag secured to a hopper assembly and the hopper assembly secured to a receiving container.

In order to empty the desired contents from a container 112 containing low density particulate material 20 and the hopper assembly 110 while separating out oversized contaminants 34, the hopper assembly 110 is releasably secured to the container 112 If the container 112 is a large plastic bag, the hopper assembly 110 further comprises an annular lip 148 over which the mouth of the bag is disposed and secured in sealing engagement by a clamping band 150 (see FIG. 4). If the container 112 is a 55 gallon drum, the annular lip 148 of the hopper assembly 110 may also be used to receive the mouth of the 55 gallon drum for clamping engagement using a conventional clamp such as a Marmon clamp.

Additionally, the hopper assembly 110 may also comprise a shoulder 154 which can rest on the open mouth of the receiving container 113 and can be used to clamp the hopper assembly 110 in releasable secured engagement with the receiving container 113. In this manner, the combination of the container 112, the hopper assembly 110, and the receiving container 113 can be a completely closed system where no airborne particles are leaked into the environment during the transfer of the low density particulate material 20 from the container 112 to the receiving container 113.

Once the hopper assembly 110 is secured to the mouth of the container 112, whether the container 112 is a plastic bag or a 55 gallon drum, the container 112 with the hopper assembly 110 secured thereto may be inverted to cause the low density particulate material 20 contents to flow. The flow of the particulate material 20, under the force of gravity, will be directed into the hopper assembly 110. The portion of the flow that does not encounter the baffle 114, falls onto the screen 122 and into the trap 116. The portion of the flow that does encounter the baffle 114, is directed away from the opening 136 and towards the trap 116. The movement of the contaminants 34 within the flow will generally be in the same direction as the flow of the low density particulate material 20. The contaminants 34 ultimately settle upon the screen within the trap 116.

As the trap 116 begins to fill with the low density particulate material 20, higher density and oversized contaminants travel in the flow and settle onto the screen 122 which is the lowermost portion of the trap 116 where such contaminants 34 are captured in the trap 116. When the trap 116 fills to near capacity, a portion of the flow will take a tortured path about the weir 118, through the exit portal 140 and exit the hopper assembly 110 through the opening 136. Heavier and oversized contaminants 34 are incapable of traveling the same tortured path and remain captured in the trap 116.

Because most of the low density particulate material 20 averts the screen 122, the low density particulate material 20 is taken from the container 112 much more rapidly than under the known screening procedure. The low density particulate materials 20 captured within the trap 116 are recovered because such materials 20 may pass through the screen 122 while leaving the contaminants 34 captured within the trap 116. Thus, the container 112 and the hopper assembly 110 may be completely emptied of the desired low density particulate material 20 while separating out the oversized contaminants 34.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. An apparatus for the removal of oversized contaminants from particulate material during the transfer of such particulate material from a container to a receiving container, comprising:

an assembly capable of secure, releasable engagement with the container, said assembly comprising a weir having a, weir trap flange extending laterally from a weir wall;

a trap disposed adjacent said weir, said trap configured such that if the container with said assembly secured thereto is maneuvered to cause the flow of the particulate material from the container to the receiving container, then the lowermost portion of said trap in the proximity of the flow of the particulate materials subtends said weir;

a permeable member for separating particulate material from oversized contaminants and permitting particulate material trapped within said trap to pass therethrough, said permeable member being disposed adjacent said weir and said trap;

a baffle spaced from said weir and disposed to deflect the flow of the particulate material towards said trap; and an opening through which particulate material will flow freely, said opening being disposed adjacent said weir and having an entry portal, said entry portal being between said baffle and said weir, thereby if the container with said assembly secured thereto is maneuvered to cause the flow of the particulate material from the container to the receiving container, then the lowermost portion of said trap in the proximity of the flow of the particulate material subtends said entry portal such that the flow of most of the particulate material averts passage through said permeable member and follows a tortured path around said baffle, through said entry portal, and over said weir to exit the container through said opening.

2. An apparatus for removing oversized contaminants from particulate material as set forth in claim 1, wherein said assembly is configured generally symmetrical about a central axis of said assembly.

3. An apparatus for removing oversized contaminants from particulate material as set forth in claim 1, wherein said permeable member comprises a screen.

4. An apparatus for removing oversized contaminants from particulate material as set forth in claim 3, wherein said screen is a #8 mesh screen.

5. An apparatus for removing oversized contaminants from particulate material as set forth in claim 1, wherein said weir is substantially cylindrical and said permeable member is annular, said weir having a base end and a top and, said permeable member encircling and being connected to said weir proximate to said base end.

6. An apparatus for removing oversized contaminants from particulate material as set forth in claim 5, wherein said assembly further comprises a second wall which is substantially cylindrical and encircles said weir in spaced substantially concentric relationship, said second wall encircles said permeable member and is connected to said permeable member such that said trap is defined by the confines of said weir, said permeable member, and said second wall.

7. An apparatus for removing oversized contaminants from particulate material as set forth in claim 6, wherein the height of said weir wall from said base end to said top end is greater than the height of said second wall.

8. An apparatus for removing oversized contaminants from particulate material as set forth in claim 5, wherein said weir trap flange extends laterally from said weir wall at said top end.

9. An apparatus for removing oversized contaminants from particulate material as set forth in claim 8, wherein said weir trap flange extends from said weir wall in a direction substantially normal to said weir wall and away from a central axis of said assembly.

10. An apparatus for removing oversized contaminants from particulate material as set forth in claim 5, wherein said baffle has a substantially conical surface.

11. An apparatus for removing oversized contaminants from particulate material as set forth in claim 10, wherein said baffle has a peripheral edge and said weir trap flange has an outermost edge, said peripheral edge of said baffle is spaced from a central axis of said assembly a distance greater than the distance of said outermost edge of said weir trap flange is spaced from the central axis.

12. An apparatus for removing oversized contaminants from particulate material as set forth in claim 1, wherein said assembly further comprises a means for sealing engagement with the container.

13. An apparatus for removing oversized contaminants from particulate material as set forth in claim 12, wherein said means for sealing engagement with the container comprises an annular ridge connector which is capable of sealing engagement with containers having an annular depression about the mouth of the container.

14. An apparatus for removing oversized contaminants from particulate material as set forth in claim 12, wherein said means for sealing engagement with the container comprises an annular lip which is capable of sealing engagement with plastic bag containers.

15. An apparatus for removing oversized contaminants from particulate material as set forth in claim 12, wherein said means for sealing engagement with the container comprises an annular lip which is capable of sealing engagement with drum containers.

16. An apparatus for removing oversized contaminants from particulate material as set forth in claim 1, wherein said weir is substantially cylindrical and said permeable member is substantially circular, said weir having a base end and a top end, said weir encircling and being connected to said permeable member proximate to said base end.

17. An apparatus for removing oversized contaminants from particulate material as set forth in claim 16, wherein said assembly further comprises an exterior wall which encircles said weir and a plurality of support members which connect said exterior wall to said weir and support said weir and said permeable member in a spaced substantially concentric disposition, such that said opening is annular and encircles said weir and said trap is defined by the confines of said weir and said permeable member.

18. An apparatus for removing oversized contaminants from particulate material as set forth in claim 17, wherein said weir trap flange extends laterally from said weir wall at said top end.

19. An apparatus for removing oversized contaminants from particulate material as set forth in claim 18, wherein said weir trap flange extends from said weir wall in a direction substantially normal to said weir wall and towards a central axis of said assembly.

20. An apparatus for removing oversized contaminants from particulate material as set forth in claim 16, wherein said baffle is substantially annular and has a surface which is disposed at an acute angle to said permeable member.

21. An apparatus for removing oversized contaminants from particulate material as set forth in claim, 20, wherein said baffle has an internal peripheral edge and said weir trap flange has an innermost edge, said internal peripheral edge of said baffle is spaced from a central axis of said assembly a distance less than the distance of said innermost edge of said weir trap flange is spaced from the central axis.

22. An apparatus for removing oversized contaminants from particulate material as set forth in claim 16, wherein said assembly further comprises an agitator for agitating the assembly to assist flow of the particulate material from the container to the receiving container.

23. An apparatus for removing oversized contaminants from particulate material as set forth in claim 16, wherein said assembly further comprises means for securing said assembly to the receiving container.

24. An assembly for the removal of oversized contaminants from particulate material during the transfer of such particulate material from a container to a receiving container, comprising:

a weir having a cylindrical weir wall with a base end and a top end and a weir trap flange extending laterally from said top end of said weir;

a trap disposed adjacent said weir, said trap configured such that if the container with the assembly secured thereto is maneuvered to cause the flow of the particulate material from the container to the receiving container, then the lowermost portion of said trap in the proximity of the flow of the particulate materials subtends said weir;

an annular permeable member for separating particulate material from oversized contaminants and permitting particulate material trapped within said trap to pass therethrough, said annular permeable member being disposed adjacent said trap and connected to said weir proximate to said base end so that said permeable member encircles said weir;

a conical baffle spaced from said weir and disposed to deflect the flow of the particulate material towards said trap; and a substantially circular opening through which particulate material will flow freely, said opening being disposed adjacent said weir and having an entry portal, said entry portal being between said baffle and said weir, thereby if the container with the assembly secured thereto is maneuvered to cause the flow of the particulate material from the container to the receiving container, then the lowermost portion of said trap in the proximity of the flow of the particulate material subtends said entry portal such that the flow of most of the particulate material averts passage through said permeable member and follows a tortured path around said baffle, through said entry portal, and over said weir to exit the container through said opening.

25. An assembly for the removal of oversized contaminants from particulate material as set forth in claim 24, wherein the assembly is configured generally symmetrical about a central axis of the assembly.

26. An assembly for the removal of oversized contaminants from particulate material as set forth in claim 24, wherein said permeable member comprises a screen.

27. An assembly for the removal of oversized contaminants from particulate material as set forth in claim 26, wherein said screen is a #8 mesh screen.

28. An assembly for the removal of oversized contaminants from particulate material as set forth in claim 24, further comprising a second wall which is substantially cylindrical and encircles said weir in spaced substantially concentric relationship, said second wall encircles said permeable member and is connected to said permeable member such that said trap is defined by the confines of said weir, said permeable member, and said second wall.

29. An assembly for the removal of oversized contaminants from particulate material as set forth in claim 28, wherein the height of said weir wall from said base end to said top end is greater than the height of said second wall.

30. An assembly for the removal of oversized contaminants from particulate material as set forth in claim 24, wherein said weir trap flange extends from said weir wall in a direction substantially normal to said weir wall and away from a central axis of the assembly.

31. An assembly for the removal of oversized contaminants from particulate material as set forth in claim 24, wherein said baffle has a peripheral edge and said weir trap flange has an outermost edge, said peripheral edge of said baffle is spaced from a central axis of said assembly a distance greater than the distance of said outermost edge of said weir trap flange is spaced from the central axis.

32. An assembly for the removal of oversized contaminants from particulate material as set forth in claim 24, further comprising means for sealing engagement with the container.

33. An assembly for the removal of oversized contaminants from particulate material as set forth in claim 32, wherein said means for sealing engagement with the container comprises an annular ridge connector which is capable of sealing engagement with containers having an annular depression about the mouth of the container.

34. An assembly for the removal of oversized contaminants from particulate material during the transfer of such particulate material from a container to a receiving container, comprising:

a weir having a cylindrical weir wall with a base end and a top end and a weir trap flange extending laterally from said top end of said weir;

a trap disposed adjacent said weir, said trap configured such that if the container with the assembly secured thereto is maneuvered to cause the flow of the particulate material from the container to the receiving container, then the lowermost portion of said trap subtends said weir;

a substantially circular permeable member for separating particulate material from oversized contaminants and permitting particulate material trapped within said trap to pass therethrough, said circular permeable member being disposed adjacent said trap and connected to said weir proximate to said base end so that said weir encircles said permeable member, said trap being defined by the confines of said weir and said permeable member;

an annular baffle spaced from said weir and disposed to deflect the flow of the particulate material towards said trap, said annular baffle having a surface which is disposed at an acute angle to said permeable member; and an annular opening through which particulate material will flow freely, said opening being disposed adjacent said weir and having an entry portal, said entry portal being between said baffle and said weir, thereby if the container with the assembly secured thereto is maneuvered to cause the flow of the particulate material from the container to the receiving container, then the lowermost portion of said trap subtends said entry portal such that the flow of most of the particulate material averts passage through said permeable member and follows a tortured path around said baffle, through said entry portal, and over said weir to exit the container through said annular opening.

35. An assembly for the removal of oversized contaminants from particulate material as set forth in claim 34, wherein the assembly is configured generally symmetrical about a central axis of the assembly.

36. An assembly for the removal of oversized contaminants from particulate material as set forth in claim 34, wherein said permeable member comprises a screen.

37. An assembly for the removal of oversized contaminants from particulate material as set forth in claim 36, wherein said screen is a #8 mesh screen.

38. An assembly for the removal of oversized contaminants from particulate material as set forth in claim 34, further comprising an exterior wall which encircles said weir and a plurality of support members which connect said exterior wall to said weir and support said weir and said permeable member in a spaced substantially concentric disposition.

39. An assembly for the removal of oversized contaminants from particulate material as set forth in claim 34, wherein said weir trap flange extends from said weir wall in a direction substantially normal to said weir wall and towards a central axis of said assembly.

40. An assembly for the removal of oversized contaminants from particulate material as set forth in claim 34, wherein said baffle has an internal peripheral edge and said weir trap flange has an innermost edge, said internal peripheral edge of said baffle is spaced from a central axis of said assembly a distance less than the distance of said innermost edge of said weir trap flange is spaced from the central axis.

41. An assembly for the removal of oversized contaminants from particulate material as set forth in claim 34, further comprising an annular lip which is capable of sealing engagement with plastic bag containers.

42. An assembly for the removal of oversized contaminants from particulate material as set forth in claim 34, further comprising an annular lip which is capable of sealing engagement with drum containers.

43. An assembly for the removal of oversized contaminants from particulate material as set forth in claim 34, further comprising an agitator for agitating the assembly to effect flow of the particulate material from the container to the receiving container.

44. An assembly for the removal of oversized contaminants from particulate material as set forth in claim 34, further comprising means for securing said assembly to the receiving container.

* * * * *